United States Patent [19]

Greenberger

[11] Patent Number: 4,556,183

[45] Date of Patent: Dec. 3, 1985

[54] SHELF MOLDING CLIP

[75] Inventor: William Greenberger, White Plains, N.Y.

[73] Assignee: The Hopp Press Inc., New York, N.Y.

[21] Appl. No.: 708,112

[22] Filed: Mar. 5, 1985

Related U.S. Application Data

[63] Continuation of Ser. No. 336,842, Jan. 4, 1981.

[51] Int. Cl.[4] ..... E04G 5/06

[52] U.S. Cl. ..... 248/221.4; 40/11 R

[58] Field of Search ..... 248/73, 221.3, 221.4, 248/229; 40/11 R, 16

[56] References Cited

U.S. PATENT DOCUMENTS

| | | | |
|---|---|---|---|
| 3,350,045 | 10/1967 | Mayers | 248/475 R |
| 3,780,209 | 12/1973 | Schuplin | 248/229 X |
| 3,796,405 | 3/1974 | Rystad | 248/489 |
| 4,016,977 | 4/1977 | Krautsack | 248/221.4 |
| 4,215,840 | 8/1980 | Babberl | 248/221.4 |
| 4,373,693 | 2/1983 | Greenberger | 248/221.4 |

*Primary Examiner*—J. Franklin Foss

*Attorney, Agent, or Firm*—Kane, Dalsimer, Kane Sullivan & Kurucz

[57] ABSTRACT

An integral plastic clip assembly is provided including a generally J-shaped body adapted for receiving a sign or marker, and opposing flanges for securing the assembly to a shelf molding. The assembly is substantially resilient so that it may easily be snapped within the molding. A clip portion, formed by the loop of the J-shaped body, is also resilient to provide a firm grip upon a sign or marker positioned therein.

2 Claims, 6 Drawing Figures

FIG.1
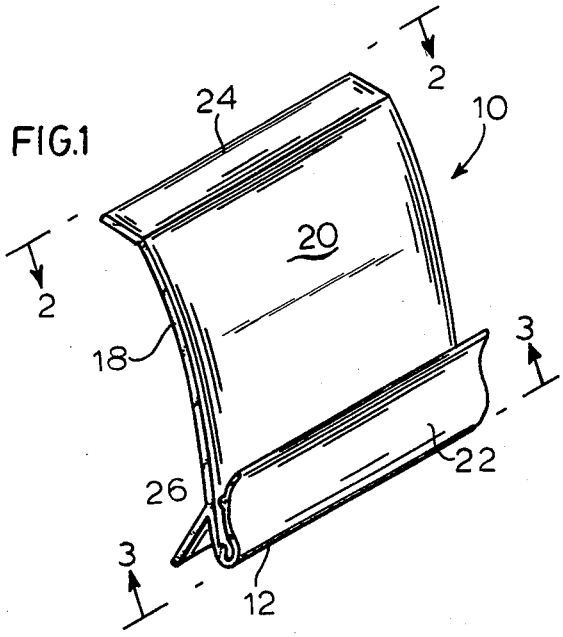
FIG 4
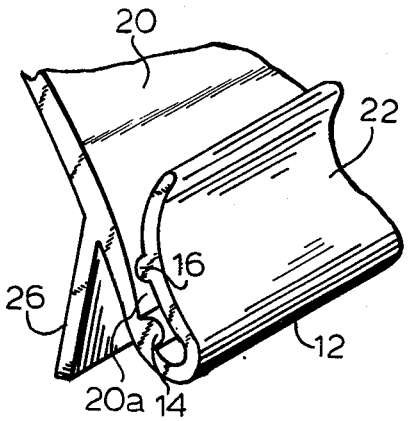
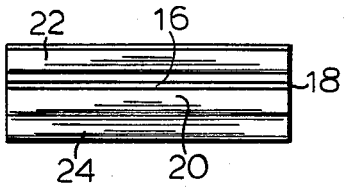
FIG 2
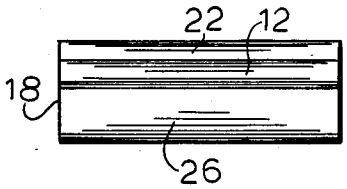
FIG 3
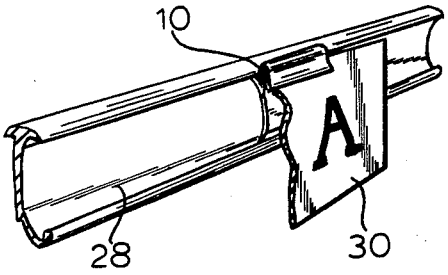
FIG 6
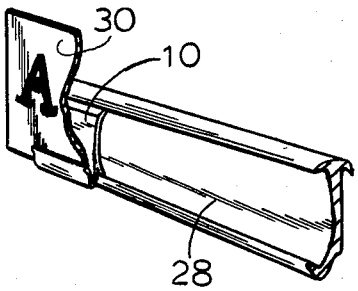
FIG 5

SHELF MOLDING CLIP

This is a continuation of co-pending application Ser. No. 336,842 filed on Jan. 4, 1982.

BACKGROUND OF THE INVENTION

1. Field of the invention

The field of the invention relates to clips for securing signs or markers to shelf moldings.

2. Brief description of the prior art

It is often desirable to secure a sign or oversized marker to a shelf molding to draw a consumer's attention to a particular product. Because the sign or marker will not fit within the flanges of the molding, clip assemblies have been employed for securing them. One such clip assembly known to the art is of U-shaped metallic construction with a pair of opposing flanges which fit within a molding. The body portion of the assembly is parallel to and spaced about half an inch from the shelf. A pair of clips are provided on the face of the body portion for receiving signs or markers. The clip assembly has the disadvantage of being rather bulky and having sharp edges.

The plastic clip assembly is disclosed in my copending application Ser. No. 166,537 filed July 7, 1980. It includes a clip having a uniquely designed base portion which is locked between the flanges of a shelf molding and an integrally mounted clip extending substantially at right angles thereto.

There are other clip assemblies in this regard however they are usually stamped out requiring a two piece or step assembly to provide for continuous lip to hold the sign or marker.

SUMMARY OF THE INVENTION

The present invention is directed to an integrally formed clear plastic clip assembly which may easily and safely be locked within a shelf molding. The assembly includes a generally J-shaped body with a pair of flanges extending therefrom. The flanges are designed for snapping within the flanges of a conventional shelf molding. The looped portion of the J-shaped body is formed as a continuous lip from the body and specifically designed to serve as a clip. A pair of ridges on opposing sides of the looped portion securely retain any sign or marker fitted therein. The looped portion is secured at an end portion of the body which advantageously allows for lining up the sign with the top or bottom of the channel in which the clip assembly is maintained.

BRIEF DESCRIPTION OF THE DRAWINGS

FIG. 1 is a perspective view of a shelf molding clip according to the invention;

FIG. 2 is an end view of the clip shown in FIG. 1 taken along the plane of line 2—2;

FIG. 3 is a view of the end of the clip opposite the end shown in FIG. 2 taken along the plane of line 3—3;

FIG. 4 is an enlarged perspective view of one end portion of the clip shown in FIG. 1;

FIG. 5 is a perspective view of the invention as employed in a shelf molding;

FIG. 6 is a perspective view of an alternative manner in which the invention may be employed within a shelf molding.

DETAILED DESCRIPTION OF THE INVENTION

A clip assembly 10 is provided for attachment to a shelf molding. The assembly is integrally molded from any suitable plastic material, preferably a clear plastic material, having sufficient resiliency for the intended purposes described below.

The clip assembly 10 include a generally flat J-shaped body defining a loop 12 at one end thereof formed as a continuous lip from the body allowing for a single piece construction as compared to stepped or two piece construction heretofore necessary. Note that the loop 12 is positioned at one end of the body so as to advantageously allow the sign to line up with the top or bottom of the channel as shown in FIGS. 5 and 6. The loop 12 is designed for retaining markers or signs therein and has sufficient memory for snapping back to its original position once the sign or marker is removed therefrom. A pair of opposing ridges 14, 16 project within the loop from opposing portions of the J-shaped body.

The longer portion 18 of the J-shaped body may have an S-shaped configuration for facilitating the engagement of the shelf molding flanges. The major part of the longer portion 18 has a slightly arcuate cross section so that the face 20 of the assembly is convex. The part of the longer portion near the loop 12 is arcuate in the opposite direction such that a concave surface **20*a* defines one inner surface of the loop. A convex surface defines the opposing inner surface of the loop as the smaller portion 22 of the J-shaped body also has an arcuate cross section. To facilitate the introduction of a sign or marker within the loop, the opening of the loop is defined by opposing convex surfaces defined by the smaller portion 22 of the body and the above-described face 20**.

A pair of flanges 24, 26 extends from the concave side of the longer body portion 18. The first flange 24 is simply a continuation of the end of this body portion 18 in a direction opposing the face 20 of the assembly. The second flange 26 extends from the rear side of portion 18 near the point where the surface of the rear side changes from concave to convex. Both flanges form substantially equal obtuse angles with the concave rear side of the body portion 18. The distal edges of the flange portions are substantially parallel to each other.

To secure the clip assembly 10 to a shelf molding 28, one first positions the assembly such that the first flange 24 lies beneath one of the flanges of the molding. Pressure is then exerted on the loop 12 in the direction of the first flange. Because the loop is formed from a smooth, curved piece of plastic, there are no sharp edges which could potentially cut one's fingers. The arcuate cross section of the longer portion 18 of the clip body allows it to bend easily while applying pressure to the loop 12. Thus, because the longer portion is arcuate in cross-section, bending of the clip into a pricing channel is facilitated. Once the second flange 26 is positioned within the opposite flange of the shelf molding, pressure on the loop is discontinued. The resilient clip will then snap back towards its original shape and be securely locked within the molding. A message display sign 30 may be inserted within the loop 12 and is engaged by the opposing inner walls thereof. Ridges 14, 16 of semicircular cross section provide a tight grip upon the sign.

What is claimed is:

1. An integral plastic clip assembly for securing a sign, marker or the like to a shelf molding comprising:

a generally flat J-shaped body defined by a first relatively long body portion and a second relatively short body portion, said second body portion and a first end portion of said first body portion defining a loop at a first end of said body for receiving and maintaining a sign with said loop being positioned to allow the line up of the sign to a shelf molding's top or bottom, said second body portion being formed as a continuous extension of said first end portion, said second body portion being arcuate in cross-section to facilitate bending of the clip into a pricing channel;

a first flange extending from a second end portion of said first body portion opposite said first end portion thereof, said flange extending from a first side of said first body portion opposite the side thereof defining a portion of said loop;

a second flange extending outwardly from said first side of said first body portion between said first flange and said loop, said first and second flanges defining first and second distal edges, respectively, which are substantially parallel to each other, said first and second flanges each forms an obtuse angle with said first side of said first body portion; and said first body portion and said first and second flanges having sufficient resiliency to allow said flanges of said clip assembly to be snapped within a shelf molding.

2. A clip assembly as defined in claim 1 including at least one ridge projecting from an interior surface of said loop engageable with a sign to maintain it therein when placed in the loop, and said assembly is constructed of a clear plastic material.

* * * * *

UNITED STATES PATENT AND TRADEMARK OFFICE

CERTIFICATE OF CORRECTION

PATENT NO. : 4,556,183

DATED : December 3, 1985

INVENTOR(S) : William Greenberger

It is certified that error appears in the above—identified patent and that said Letters Patent is hereby corrected as shown below:

In claim 1, line 12, change "second" to --first--.

Signed and Sealed this

Eighth Day of March, 1988

*Attest:*

DONALD J. QUIGG

*Attesting Officer*

*Commissioner of Patents and Trademarks*